US011583009B2

(12) United States Patent
Yehuda

(10) Patent No.: US 11,583,009 B2
(45) Date of Patent: Feb. 21, 2023

(54) SOCK WITH LATERAL TOE SEAM

(71) Applicant: NIKE, Inc., Beaverton, OR (US)

(72) Inventor: Ronen Yehuda, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/704,352

(22) Filed: Dec. 5, 2019

(65) Prior Publication Data

US 2020/0205484 A1 Jul. 2, 2020

Related U.S. Application Data

(60) Provisional application No. 62/785,891, filed on Dec. 28, 2018.

(51) Int. Cl.
*A41B 11/01* (2006.01)
*A41B 11/00* (2006.01)

(52) U.S. Cl.
CPC ..... *A41B 11/01* (2013.01); *A41B 11/002* (2013.01)

(58) Field of Classification Search
CPC ..... A41B 11/01; A41B 11/002; A41B 11/08; A41B 11/004; D04B 1/26
USPC ..... 2/239, 240, 241
See application file for complete search history.

(56) References Cited

U.S. PATENT DOCUMENTS 246,454 A * 8/1881 Bruen ..... D04B 1/26 66/187
335,704 A * 2/1886 Hoult ..... A41B 11/01 2/239
482,095 A * 9/1892 McClurg ..... D04B 1/26 66/187
1,459,590 A * 6/1923 Junker ..... A41B 11/02 2/239
1,665,946 A * 4/1928 Boehme ..... D04B 11/28 66/183
1,680,859 A * 8/1928 Capareli ..... D04B 1/26 66/182
1,726,441 A * 8/1929 Loven ..... D04B 1/26 66/185
1,731,696 A * 10/1929 Zinky ..... A41B 11/02 2/239

(Continued)

FOREIGN PATENT DOCUMENTS

AU 5206799 A 1/2000
CA 2883763 A1 9/2016

(Continued)

OTHER PUBLICATIONS

"circulator compression knee high—smaller feet," Sock Dreams, sockdreams.com, sockwell, SKU [SW]-[SW1W], accessed: Jul. 2018. https://www.sockdreams.com/circulator-compression-knee-high-smaller-feet.html.
"cassie casual sheer stripe anklet," Sock Dreams, sockdreams.com, Tavi Noir, SKU [TN]-[T02822S], accessed: Jul. 2018. https://www.sockdreams.com/cassie-casual-sheer-stripe-anklet.html.

(Continued)

*Primary Examiner* — Jocelyn Bravo
(74) *Attorney, Agent, or Firm* — Shook, Hardy & Bacon L.L.P.

(57) ABSTRACT

Concepts provided are directed to a sock having a toe seam that is primarily located on a lateral side of the sock. The sock may comprise a foot locating feature to ensure that the wearer dons a right footed sock on a right foot and a left footed sock on a left foot so that the toe seam is localized to the lateral side of the wearer's foot when the sock is worn by the wearer.

20 Claims, 13 Drawing Sheets

(56) References Cited

U.S. PATENT DOCUMENTS 1,789,494 A * 1/1931 Page ..... D04B 1/108 66/187
1,870,701 A 8/1932 Williams
1,906,137 A 4/1933 Davis
1,954,711 A * 4/1934 Oliver ..... D04B 11/28 66/183
1,975,706 A 10/1934 Allen
1,984,970 A * 12/1934 Goodman ..... A41B 11/01 2/239
1,987,090 A * 1/1935 Weinholz ..... A41B 11/01 2/239
2,002,888 A 5/1935 Gastrich
2,047,724 A 7/1936 Zuckerman
2,061,160 A * 11/1936 Kendall Edna ..... A43B 3/20 36/72 R
2,217,273 A 10/1940 Harris
2,237,652 A * 4/1941 Capezio ..... A43B 5/12 36/8.3
2,247,832 A 7/1941 Burd et al.
2,248,303 A * 7/1941 Morgenroth ..... A61F 13/064 2/239
2,250,257 A 7/1941 Eissner et al.
2,391,064 A * 12/1945 Stokes ..... A43B 23/28 2/239
2,400,692 A * 5/1946 Herbert ..... D04B 1/26 36/10
2,412,087 A * 12/1946 Herbert ..... A41B 11/00 66/187
2,424,056 A 7/1947 Ruth
2,514,456 A 7/1950 Carl
2,616,275 A 11/1952 Bennington
2,628,438 A * 2/1953 Luchs ..... A43B 1/02 36/10
2,629,995 A 3/1953 John
2,629,996 A * 3/1953 Hamilton ..... D04B 1/26 66/172 R
2,771,691 A * 11/1956 Luchs ..... A43B 17/00 36/10
3,015,942 A * 1/1962 Getaz ..... A41B 11/01 66/186
3,173,278 A 3/1965 Kaylor
3,187,522 A 6/1965 Knohl
3,289,328 A * 12/1966 Abel ..... A41B 11/00 36/9 R
3,334,356 A * 8/1967 Abel ..... A43B 23/28 2/239
3,601,818 A * 8/1971 Chesebro ..... D04B 1/26 2/239
3,793,851 A * 2/1974 Thorneburg ..... D04B 1/02 66/185
3,838,583 A 10/1974 Rumi et al.
3,887,946 A * 6/1975 Laskin ..... A43B 3/00 2/239
4,194,249 A * 3/1980 Thorneburg ..... D04B 1/02 2/239
4,197,721 A 4/1980 Hofmann et al.
4,631,755 A * 12/1986 Zingg ..... D04B 1/26 2/239
4,723,364 A * 2/1988 Marxer ..... A43B 5/0405 36/10
5,020,164 A * 6/1991 Edwards ..... A41B 11/00 2/239
5,054,129 A 10/1991 Baehr
5,095,548 A * 3/1992 Chesebro, Jr. ..... D04B 1/04 2/239
5,230,333 A 7/1993 Yates et al.
5,450,630 A * 9/1995 Hale ..... A41B 11/00 2/239
5,560,226 A * 10/1996 Throneburg ..... A41B 11/02 66/185
D375,195 S 11/1996 Panassidi
5,603,232 A * 2/1997 Throneburg ..... A41B 11/02 2/239
5,784,721 A * 7/1998 Huff ..... A41B 11/02 2/239
5,867,837 A * 2/1999 Otto ..... A41B 11/00 2/239
5,867,838 A * 2/1999 Corry ..... A43B 19/00 2/239
5,906,007 A * 5/1999 Roberts ..... A41B 11/004 2/239
6,044,497 A * 4/2000 Richardson ..... A41B 11/00 2/239
6,173,589 B1 * 1/2001 Hayes, Jr. ..... A41B 11/10 2/239
6,226,800 B1 5/2001 Islar
6,324,698 B1 * 12/2001 Freeman ..... A41B 11/00 2/239
6,381,755 B2 * 5/2002 Cortani ..... A41B 11/004 2/239
6,393,620 B2 * 5/2002 Hatch ..... A41B 11/00 2/239
6,415,448 B1 * 7/2002 Glogover ..... A41B 11/00 2/239
6,564,392 B1 * 5/2003 Buckwald ..... A41B 11/10 2/239
D476,147 S 6/2003 Campbell
6,708,348 B1 * 3/2004 Romay ..... D04B 1/26 2/239
D488,918 S 4/2004 Mays et al.
7,051,457 B1 * 5/2006 Huggins ..... A41B 11/004 2/238
7,103,922 B1 * 9/2006 Doorley ..... A41B 11/004 2/239
7,107,626 B1 9/2006 Andrews
D538,527 S * 3/2007 Ransan ..... D2/989
7,213,417 B2 5/2007 Lonati et al.
D543,676 S * 6/2007 Kim ..... D2/919
D581,654 S 12/2008 Miliotis
7,673,396 B2 * 3/2010 Terlizzi ..... A43B 7/1425 36/8.3
7,849,609 B2 * 12/2010 Edington ..... A43B 23/042 36/48
7,856,739 B2 * 12/2010 Terlizzi ..... A43B 7/1445 36/8.3
7,882,714 B2 * 2/2011 Roberts ..... D04B 7/34 66/186
8,156,768 B2 * 4/2012 Green ..... D04B 1/26 66/187
8,448,350 B2 5/2013 Nataadiningrat et al.
9,380,831 B2 7/2016 Craig et al.
D769,611 S 10/2016 Ramirez-Tellez Shah
9,609,896 B2 4/2017 Crosby
9,661,892 B2 5/2017 Meir
D791,466 S * 7/2017 Flynn ..... D2/980
D802,292 S 11/2017 Patterson
D803,543 S 11/2017 Scott et al.
D803,544 S 11/2017 Ramirez-Tellez Shah
10,039,329 B2 * 8/2018 Sherry ..... A41B 11/006
10,077,512 B2 * 9/2018 Kuo ..... D04B 1/00
10,106,921 B2 * 10/2018 Ciocca ..... D04B 1/26
2006/0218973 A1 10/2006 Kim et al.
2008/0034802 A1 2/2008 Hirao et al.
2009/0158504 A1 * 6/2009 Sparrow ..... D04B 1/26 2/239
2010/0037370 A1 * 2/2010 Busi ..... D04B 1/108 2/239
2010/0050321 A1 3/2010 Martini
2013/0152275 A1 * 6/2013 Crosby ..... A41B 11/004 2/239
2013/0160192 A1 6/2013 Stuart
2014/0033567 A1 * 2/2014 Heathcote ..... A43B 5/12 36/92
2014/0317833 A1 * 10/2014 Craig ..... A41B 11/00 2/239
2016/0029704 A1 * 2/2016 Jung ..... A41B 11/00 2/239

(56) References Cited

U.S. PATENT DOCUMENTS

| | | | | |
|---|---|---|---|---|
| 2016/0081836 | A1* | 3/2016 | Sawle | A41B 11/003 602/28 |
| 2016/0227843 | A1* | 8/2016 | Bilsky | A41B 11/01 |
| 2016/0242471 | A1* | 8/2016 | Marville | A41B 11/003 |
| 2017/0143059 | A1* | 5/2017 | Gallagher | B32B 7/08 |
| 2017/0175310 | A1 | 6/2017 | Rees-Jones et al. | |
| 2017/0347723 | A1* | 12/2017 | Millet | A61F 5/019 |
| 2018/0220714 | A1* | 8/2018 | Amis | D04B 1/108 |
| 2018/0343927 | A1* | 12/2018 | Roe | A41B 11/005 |
| 2019/0167462 | A1* | 6/2019 | Shaffer | A61F 5/019 |
| 2020/0205480 | A1* | 7/2020 | Giorgi | D04B 1/28 |
| 2020/0205481 | A1* | 7/2020 | Amis | D04B 9/20 |

FOREIGN PATENT DOCUMENTS

| | | | | |
|---|---|---|---|---|
| CH | 313745 | | 5/1956 | |
| CN | 200966318 | Y | 10/2007 | |
| CN | 202197844 | U | 4/2012 | |
| CN | 203814602 | U | 9/2014 | |
| CN | 106307626 | A | 1/2017 | |
| CN | 106605951 | A | 5/2017 | |
| CN | 107173854 | A | 9/2017 | |
| DE | 202012004652 | U1 | 8/2013 | |
| GB | 2138852 | A | 10/1984 | |
| GB | 2378891 | A | 2/2003 | |
| GB | 2472586 | A | 2/2011 | |
| JP | 3114044 | U | 9/2005 | |
| JP | 3117585 | U | 1/2006 | |
| JP | 5961781 | B1 | 7/2016 | |
| KR | 10-0709266 | B1 | 4/2007 | |
| KR | 101071167 | B1 | 9/2011 | |
| TW | M483681 | U | 8/2014 | |
| WO | 00/00049 | A1 | 1/2000 | |
| WO | 2004/023904 | A1 | 3/2004 | |
| WO | 2012032458 | A2 | 3/2012 | |
| WO | WO-2012032458 | A2 * | 3/2012 | A41B 11/01 |

OTHER PUBLICATIONS

"SmartKnit Big Toe AFO Socks for Adults," Knit-Rite® direct, knitritedirect.com, item #: KR-SK-BTS-A, accessed: Jul. 2018. https://www.knitritedirect.com/smartknit-big-toe-afo-socks-for-adults.html.

International Search Report and Written Opinion received for PCT Patent Application No. PCT/US2019/065421, dated Mar. 19, 2020, 15 pages.

International Search Report and Written Opinion received for PCT Patent Application No. PCT/US2019/065423, dated Mar. 24, 2020, 11 pages.

BellissimoFromItaly, "Stretch Lace Thong Sock Black Toeless Lace Sock Black Lace Socks Sandal Foot Bear Toes Stockings", Etsy, Available online at: <https://www.etsy.com/listing/575332428/stretch-lace-thong-sock-black-toeless>, Jul. 22, 2018, 4 pages.

"Brand New Ballet Dance Toe Pad Practice Shoes Foot Thong Protection Dance Sock for Latin Costume Gaiters Accessories", "AliExpress&trade, Available online at: <https://www.aliexpress.com/item/Brand-New-Ballet-Dance-Toe-Pad-Practice-Shoes-Foot-Thong-Protection-Dance-Sock-for-Latin-Costume/32582526563.html>", Accessed on Jul. 30, 2018, 7 pages.

"Wholesale-Footful Pair Foot Thong Toe Undies, Dance Paws, Half Lyrical Shoe Forefoot Cover Sock H1274", DHgate,Available online at: <https://www.dhgate.com/product/wholesale-footful-pair-foot-thong-toe-undies/264994642.html>, Accessed on Jul. 30, 2018,6 pages.

International Preliminary Report on Patentability received for PCT Patent Application No. PCT/US2019/065421, dated Jul. 8, 2021, 9 pages.

International Preliminary Report on Patentability received for PCT Patent Application No. PCT/US2019/065423, dated Jul. 8, 2021, 8 pages.

Non-Final Office Action received for U.S. Appl. No. 16/704,089, dated Oct. 7, 2021, 25 pages.

Final Office Action received for U.S. Appl. No. 16/704,089, dated Mar. 3, 2022, 27 pages.

* cited by examiner

SOCK WITH LATERAL TOE SEAM

CROSS-REFERENCE TO RELATED APPLICATIONS

This application, assigned U.S. application Ser. No. 16/704,352, filed Dec. 5, 2019, and entitled "Sock with Lateral Toe Seam," claims the benefit of priority to U.S. Provisional Application No. 62/785,891, filed Dec. 28, 2018, and entitled "Sock With Lateral Toe Seam," the entirety of which is incorporated by reference herein.

TECHNICAL FIELD

Aspects herein relate to a sock having a toe seam that is primarily located on a lateral side of the sock.

BACKGROUND

Traditionally, socks are formed of a tubular structure having a closed end and an open end, where the closed end may also be referred to as the toe end, and the open end may also be referred to as the ankle or foot opening. The toe end of traditional socks is generally formed by closing the tubular structure forming the closed end of each sock with a toe seam that typically extends from a medial side to a lateral side of the sock.

BRIEF DESCRIPTION OF THE SEVERAL VIEWS OF THE DRAWINGS

The present invention is described in detail below with reference to the attached drawing figures, wherein.

DETAILED DESCRIPTION

Figure 1:
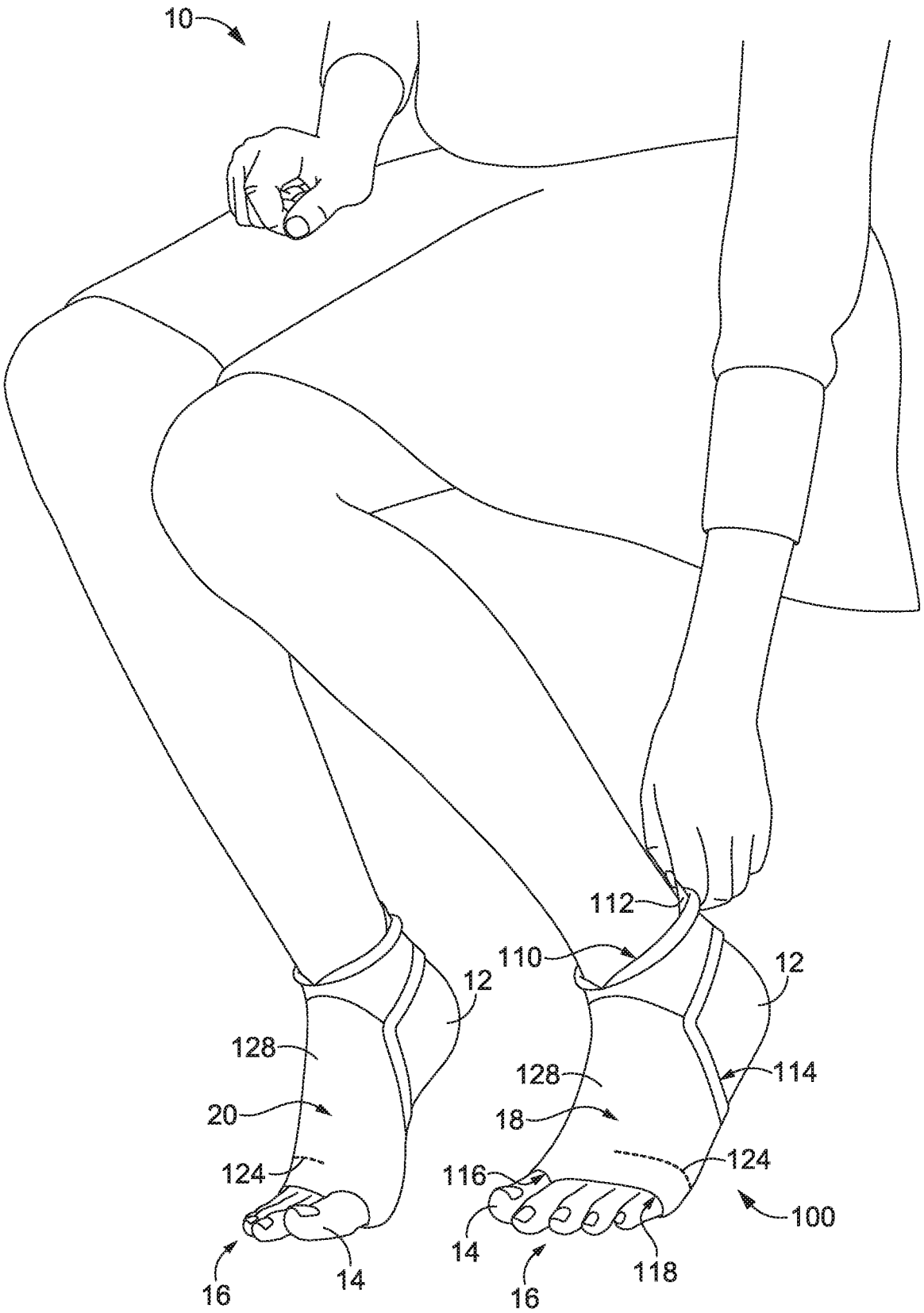
FIG. 1 illustrates a wearer donning an open toe sock having a toe seam primarily located on a lateral side of the open toe sock, in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are generally directed to a sock for athletic wear having a toe seam located primarily on a lateral side of the sock. An advantage of the toe seam being primarily located on the lateral side of the sock is that comfort for a wearer is improved by presenting an unseamed surface to the medial side of a wearer's foot, particularly to the area of the first hallux (i.e., big toe) of the wearer's foot. In one aspect, the sock comprises a tubular body having a textile wall. The sock may additionally comprise features such as a collar that forms a perimeter edge around a foot opening for receiving a wearer's foot when the sock is worn, a heel opening through which a portion of a wearer's heel extends when the sock is worn, as well as one or more toe openings through which a wearer's toes extend when the sock is worn. In accordance with aspects herein, when a bisecting reference plane bisects the tubular body of the sock into a medial side and a lateral side on opposing sides of the tubular body, the medial side is different from the lateral side at the toe end of the sock since, as described above, the toe seam is primarily located on the lateral side of the toe end.

In aspects, when the sock is an open toe sock, the tubular body may comprise a foot locating feature that is located on the medial side of the tubular body when bisected by the bisecting reference plane. In one example aspect, the foot locating feature may be generally configured to engage an anatomical region of a medial portion of a foot of a wearer when the sock is worn by the wearer. For instance, the foot locating feature may be in the form of a toe anchor that engages an area between the wearer's first hallux and the wearer's second hallux. In this aspect, the toe seam would be located on an opposite side of the bisecting reference plane from the toe anchor. Other foot locating features are contemplated herein such as textures, graphics, knit structures, and the like, where these foot locating features may be located on the medial side of the tubular body when bisected by the bisecting reference plane.

With reference to the bisecting reference plane, the toe seam comprises a first terminal end and a second terminal end. The total length of the toe seam (e.g., the toe-seam length) is the distance between the first terminal end and the second terminal end along the toe seam. In other words, the length of the toe seam extends from the first terminal end to the second terminal end of the toe seam. In one aspect, the bisecting reference plane may extend through at least the first terminal end of the toe seam. In another aspect, the bisecting reference plane may extend through both the first terminal end and the second terminal end of the toe seam, where the toe seam extends from a dorsal portion of the sock to a plantar portion of the sock.

In aspects, the sock comprising the tubular body may be described as having a medial dorsal portion, a medial plantar portion, a lateral dorsal portion, and a lateral plantar portion. When the bisecting reference plane bisects the tubular body of the sock, the medial dorsal portion and the medial plantar portion are located on a first side of the bisecting reference plane and the lateral dorsal portion and the lateral plantar portion are located on a second side of the bisecting reference plane, where the first side of the bisecting reference plane is opposite to the second side of the bisecting reference plane.

Continuing, for an open toe sock having a foot locating feature in the form of a toe anchor, the foot locating feature may extend from the medial dorsal portion of the toe opening to the medial plantar portion of the toe opening of the sock. Thus, the foot locating feature or toe anchor may divide the toe opening into at least two toe openings, with a first toe opening having a first circumference and first diameter and a second toe opening having a second circumference and a second diameter. And, in example aspects, the first circumference and first diameter of the first toe opening may be less than the second circumference and second diameter of the second toe opening. The first toe opening may be configured to receive a first hallux of the wearer when the sock is worn, and the second toe opening may be configured to receive the remaining toes of the wearer when the sock is worn. In other words, the foot locating feature or toe anchor engages the first web space of a wearer's foot that is between the first hallux and the second hallux of the wearer's foot, when the sock is worn. Thus, the open toe version of a pair of socks in accordance with aspects herein will have a right footed sock and a left footed sock to properly engage each foot of a wearer when the pair of socks is worn. It is contemplated that the open toe sock described herein may be suitable for activities such as yoga, bane classes, Pilates, and the like which require the wearer's feet and toes to be able to frictionally engage a floor or exercise surface. In other words, the exposed toes of a wearer may grip the exercise surface.

In other aspects, the sock in accordance with aspects herein may comprise an open heel, or an opening in a heel portion of the sock, to expose the heel of the wearer so that the heel of the foot of the wearer can frictionally engage an exercise surface. In further aspects, the sock may comprise both an open toe and an open heel to provide more contact surface area of the foot of the wearer with the exercise surface, which may lead to greater control in physical activities that require balancing such as those mentioned above.

It is contemplated that the tubular body of the sock having the toe seam located on the lateral side of the sock, in accordance with aspects herein, is knit on a circular knitting machine. In example aspects, at least the toe portion of the sock may comprise a series of reciprocally knit sections that are knit on the circular knitting machine using one or more sets of needles, while remaining needles on the circular knit machine are inactive. The series of reciprocally knit sections are integrally knit with each other, and it least one edge of one of the reciprocally knit sections comprises a free edge (i.e., an edge that is not integrally knit with another reciprocally knit section or with another portion of the sock). The free edge may be seamed to, for instance, the tubular body of the sock to form the toe seam, where the toe seam is generally located on the lateral side of the sock. It is contemplated herein that a technical face of the tubular body is external facing and the technical back of the tubular body is internal facing. That is, the technical back of the tubular body of the sock is configured to face inwardly and is configured to be adjacent to a wearer's foot when the sock is worn.

Positional terms as used herein such as "medial," "lateral," "front," "back" "interior surface," "exterior surface," "external facing," "internal facing," "inferior," "upper," "lower," "superior," "top," "plantar," "dorsal," and the like, are with a sock being worn as intended and as shown and described herein by a wearer standing in anatomical position. Thus, the medial side of the sock is positioned adjacent to a medial side of a wearer's foot, a lateral side of the sock is positioned adjacent to a lateral side of the wearer's foot, a plantar side of the sock is positioned adjacent to a sole of the wearer's foot, and the dorsal side of the sock is positioned adjacent to the dorsum of the wearer's foot. An internal facing surface of the sock is configured to be positioned toward a skin surface of a wearer, and an external facing surface of the sock is configured to face away from the skin surface of the wearer.

The term "knit course" as described herein is a predominantly horizontal row of knitted loops (in an upright fabric as knit) produced by adjacent needles during the same knitting cycle. The knit course may comprise one or more stitch types such as a loop stitch, a held stitch, a float stitch, a tuck stitch, a transfer stitch, and the like as these terms are known in the art of knitting. The term "integrally knit" as used herein may mean a textile or fabric having a yarn from one or more knit courses of one area being interlooped with one or more knit courses of another area. The term "technical back" as used herein refers to the inner side or underside of the fabric or textile as it is being knit. The term "technical back" may also be defined as the side of the fabric or textile that contains back loops or purl loops. And the term "technical face" as used herein refers to the outer or upper side of the fabric or textile as it is being knit. The term "technical face" may also be defined as the side of the fabric or textile that contains face loops or weft knit loops. The term "elastomeric" as used herein when describing yarns generally means a yarn type that may provide a maximum stretch greater than about 200% under load prior to returning to its non-stretched state when the load is removed, and some elastomeric yarns provide a maximum stretch of about 400%. Examples of elastomeric yarn types include, LYCRA®, elastane, spandex, rubber, and the like. The term "about" used when, for instance, describing numerical ranges means within ±10% of a designated value unless indicated otherwise.

As used herein, the term "seam" may be defined as an area where two or more edges of a textile are joined together using affixing technologies such as stitching, adhesive, bonding, and the like. In aspects, the seam may be formed in a post-knitting step or may occur simultaneously during the knitting step. Further, the term "foot locating feature" may be defined as a feature (e.g., toe anchor, graphic, texture, pattern, knit structure, and the like) present on the sock that will aid a wearer in differentiating a right footed sock from a left footed sock. This is so that the wearer can don the proper sock on the respective foot in order to experience the full benefits and comfort characteristics provided by the pair of socks in accordance with aspects herein.

Continuing, the term "toe anchor" may be defined as a structure in an open toe sock configured to separate a wearer's first hallux from the remaining toes of the wearer's foot. In some aspects, the toe anchor may be formed in a post-knitting step and secured to the sock using affixing technologies such as stitching, bonding, or adhesives. In another aspect, at least one end of the toe anchor may be integrally knit with the tubular body and the other end of the toe anchor may be secured to the tubular body using the affixing technologies described herein. In yet other aspects, the toe anchor may be integrally knit with the tubular body such that both first and second ends of the toe anchor are integrally knit with the tubular body. For instance, a toe-anchor may be integrally knit with the tubular body if a yarn from one or more knit courses of the toe-anchor is interlooped with one or more knit courses in the tubular body of the open toe sock. Moreover, the term "bisecting reference plane" may be defined as a plane positioned such that it extends through the middle of each sock, dividing the sock into generally equal lateral and medial halves, in accordance with aspects herein. In other words, the bisecting reference plane divides a sock into a generally equal (e.g., in terms of surface area) medial half and a lateral half. The medial half may also be referred to as a "medial side" and the "lateral half" may also be referred to as the "lateral side," in accordance with aspects herein. Unless indicated otherwise, all measurements provided herein are with respect to the sock in a resting state (i.e., a non-stretched) state at standard ambient temperature and pressure (298.15 K and 100 kPa).

Additional objects, advantages, and novel features of the invention will be set forth in part with reference to the figures, as follows, and in part will become apparent to those skilled in the art upon examination of the following, or may be learned by practice of the invention.

Turning now to FIG. 1, a wearer 10 is shown donning an open toe sock 100 comprising a toe seam 124 primarily located on a lateral side of the open toe sock 100. The open toe sock 100 further comprises a tubular body 128, a collar 110 and an optional integrally knit tab 112 positioned interior to the collar 110 in accordance with aspects herein. The open toe sock 100 is shown in the form of a liner sock or a ped sock although other sock lengths are contemplated herein such as a no-show sock, a quarter sock, a crew sock, or an over-the-calf or executive sock. To don the open toe sock 100, once the wearer 10 inserts her foot into a foot opening defined by the collar 110 (better shown in FIG. 2 and labelled by reference numeral 126), the wearer 10 exerts an upward tension on the collar 110 or the optional integrally knit tab 112, which when present, may act as a lever to pull the collar 110 around the wearer's left foot 18 or right foot 20, respectively.

Figure 2:
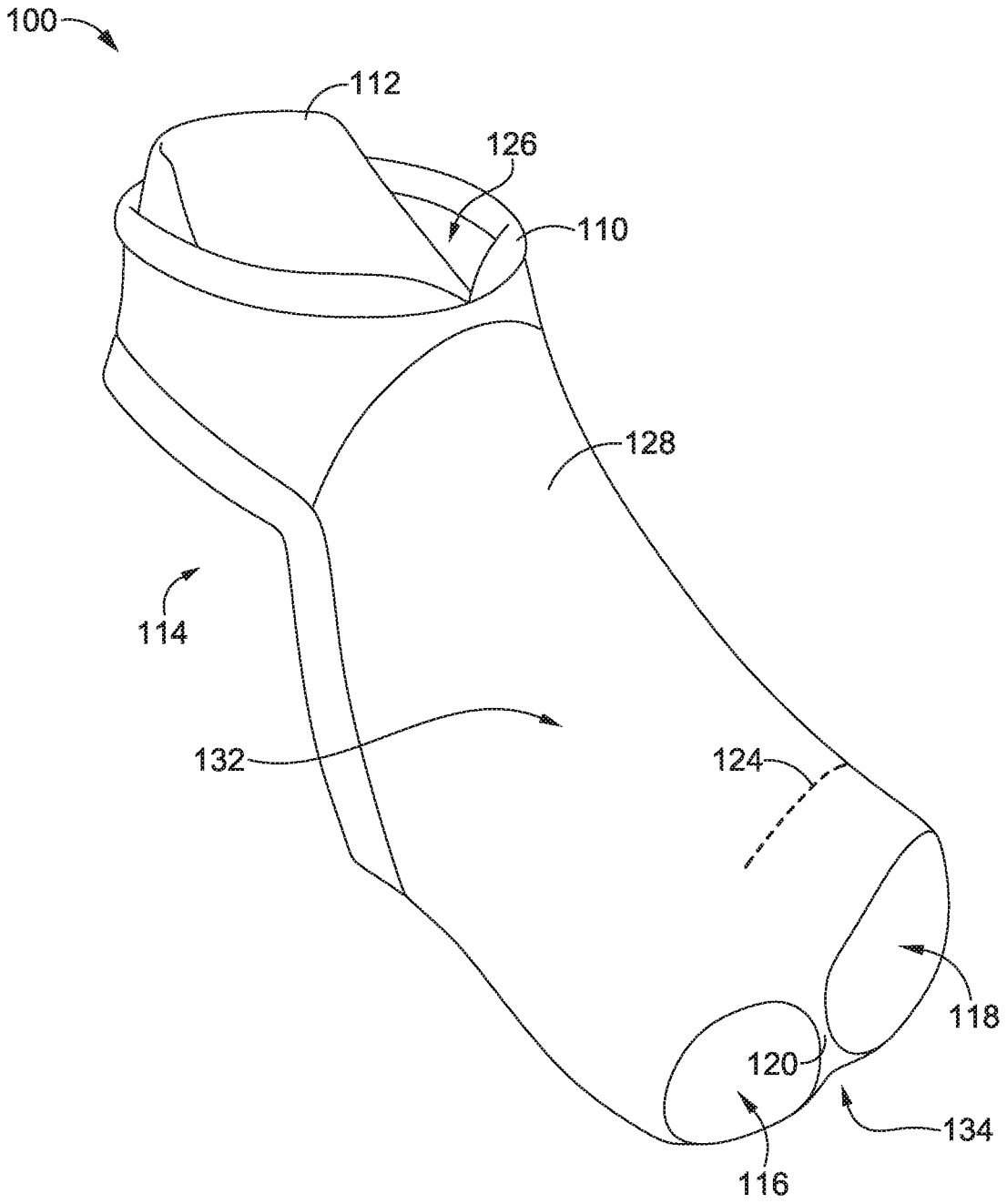
FIG. 2 illustrates a perspective view of the open toe sock of FIG. 1 in an un-worn configuration, in accordance with aspects herein.

With further respect to FIG. 1, additional optional features of the open toe sock 100 are depicted including a heel opening 114 through which at least a portion of the wearer's heel 12 extends, and one or more toe openings including a first toe opening 116 through which a first hallux 14 of the wearer 10 extends and a second toe opening 118 through which the wearer's remaining toes 16 extend. As briefly described above, the open toe sock 100 may be suitable for activities such as yoga, barre classes, Pilates, and the like which require the wearer's feet and toes to be able to grab a floor or exercise surface. Because of the number of openings, it may be difficult to orient the open toe sock 100 such that the wearer 10 inserts her foot in the correct opening. To facilitate orientation, as shown in FIG. 2, the open toe sock 100 may comprise one or more foot locating features that differentiate a right footed sock from a left footed sock, such as a toe anchor 120 that extends from a top/dorsal portion 132 of the open toe sock 100 to a plantar portion of the open toe sock 100 and divides the toe end opening of the open toe sock 100 into the first toe opening 116 and the second toe opening 118. As explained further below, the toe anchor 120 may be positioned on a medial side of the open toe sock 100 such that the circumference and/or diameter of the first toe opening 116 is less than the circumference and/or diameter of the second toe opening 118. The difference in the circumferences and/or diameters of the first and second toe openings 116 and 118 may act as a visual indicator of whether the open toe sock 100 is a right footed sock or a left footed sock. If present, the optional integrally knit tab 112 may also act as a visual indicator of the correct foot opening 126 through which the wearer's foot is to be inserted. As well, visual indicia (not shown) and/or different textures (not shown) may be integrally knit into the tubular body 128 and/or printed on to the tubular body 128 to indicate whether the open toe sock 100 is a right footed sock or a left footed sock. For example, the visual indicia may include alphanumeric characters, graphic designs, and the like, that may be included on the top/dorsal portion 132 or the plantar portion of the tubular body 128 of the open toe sock 100.

Figure 4:
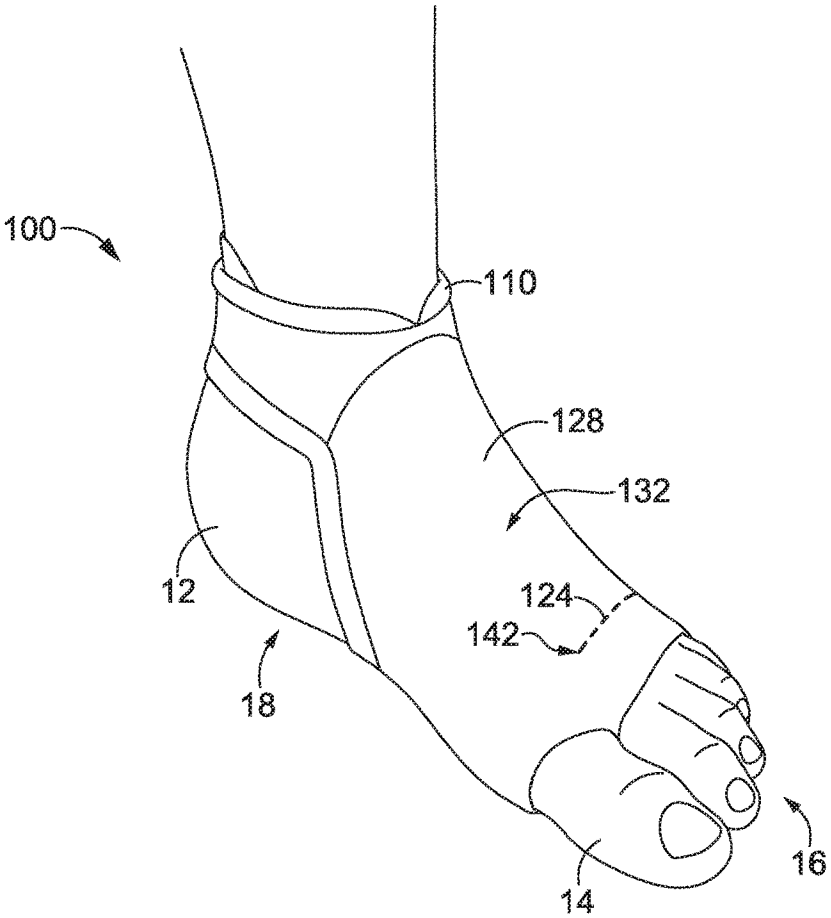
FIG. 4 illustrates a medial side perspective view of the open toe sock of FIG. 3, in accordance with aspects herein.
Figure 3:
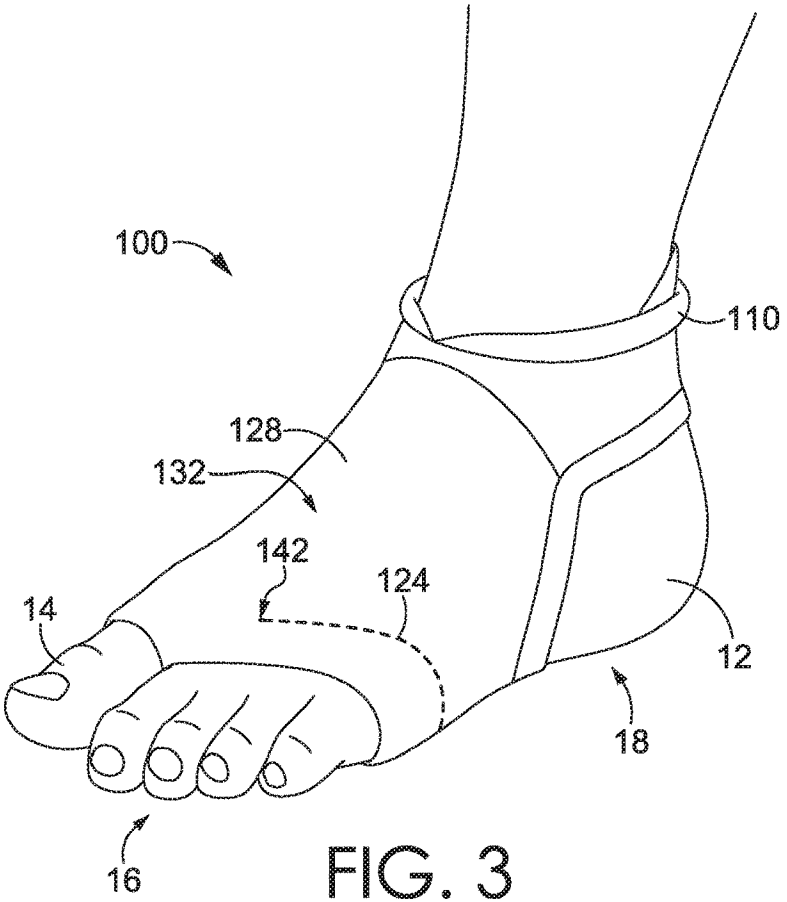
FIG. 3 illustrates a lateral side perspective view of the open toe sock of FIG. 1 donned on a wearer's left foot, where the open toe sock comprises a toe seam primarily located on a lateral side of the open toe sock, in accordance with aspects herein.

FIG. 3 illustrates a lateral side perspective view of the open toe sock 100 donned on the wearer's left foot 18, in accordance with aspects herein. And FIG. 4 illustrates a medial side perspective view of the open toe sock 100 in accordance with aspects herein. As shown, the toe seam 124 is primarily located on the lateral side of the open toe sock 100. The toe seam configuration in accordance with aspects herein, improves comfort of a wearer by avoiding pressure points potentially caused by a seam to the medial toe/foot portion of, for example, the wearer's left foot 18 (as shown) and the wearer's right foot 20 (not shown). The pressure points are undesirable since in some instances, they may cause painful chaffing. This may be especially true when the open toe sock 100 is worn for activities such as, for example, bane classes where contact of the medial side of the wearer's foot with a surface may frequently occur.

Figure 5B:
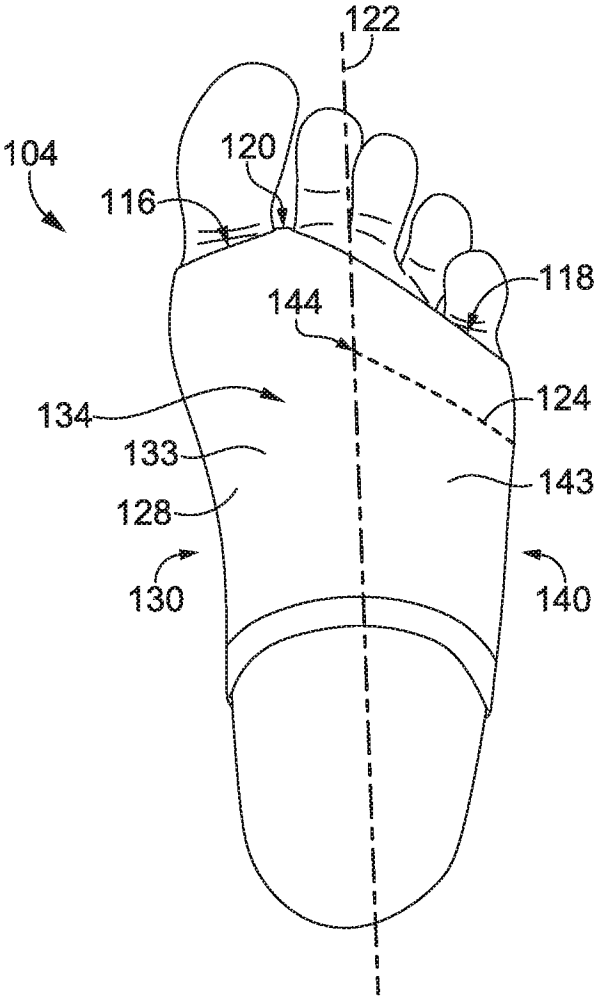
FIG. 5B illustrates a plantar view of the open toe sock of FIG. 3 with the bisecting reference plane of FIG. 5A that separates the lateral side and the medial side of the open toe sock, and further shows the toe seam extending to a plantar portion of the open toe sock, in accordance with aspects herein.
Figure 5A:
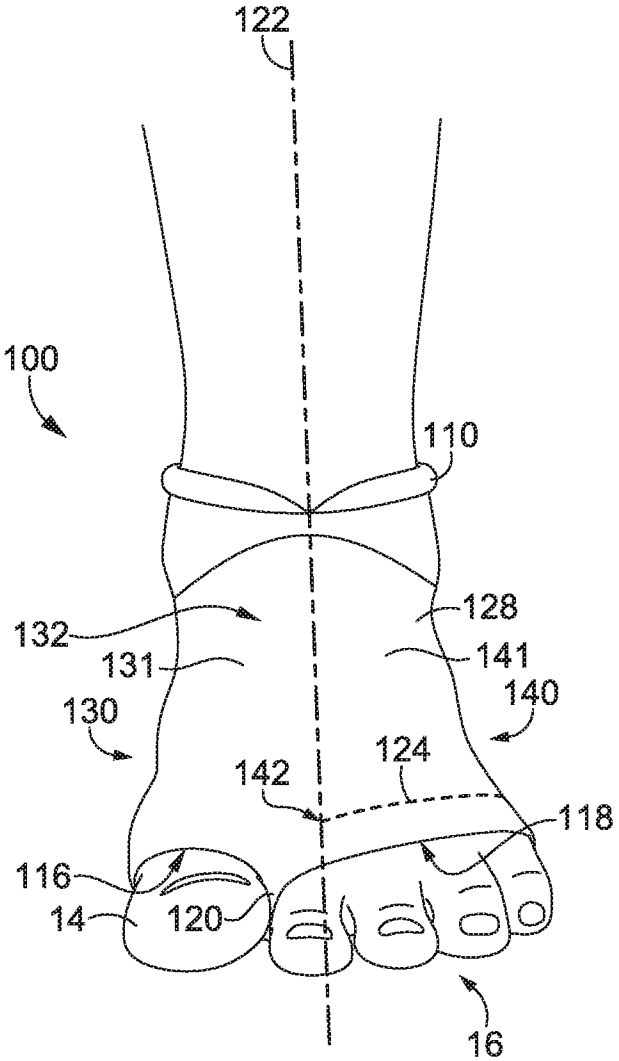
FIG. 5A illustrates a front view of the open toe sock of FIG. 3, showing a bisecting reference plane that separates a medial side of the open toe sock from a lateral side of the open toe sock, in accordance with aspects herein.

FIG. 5A illustrates a front view of the open toe sock 100 in an as-worn configuration, and FIG. 5B illustrates a plantar view of the open toe sock 100 in the as-worn configuration. For illustrative purposes, the open toe sock 100 may be bisected by a bisecting reference plane 122, bisecting the open toe sock 100 into a medial side half 130 and a lateral side half 140 having generally equal surface areas. The medial side half 130 is comprised of a medial dorsal portion 131 and a medial plantar portion 133. Similarly, the lateral side half 140 is comprised of a lateral dorsal portion 141 and a lateral plantar portion 143.

Continuing with reference to FIGS. 5A and 5B, the toe anchor 120 is located on the medial side half 130, and extends from the medial dorsal portion 131 of the medial side half 130 of the open toe sock 100 to the medial plantar portion 133 of the medial side half 130, as shown in FIG. 5B. The toe anchor 120, because of its location, may serve as a foot locating feature to signal, for example the wearer 10, whether the open toe sock 100 should be worn on the left foot 18 or on the right foot 20. Further, as discussed above with reference to FIG. 2, the toe anchor 120 also helps define a circumference of the first toe opening 116 and the second toe opening 118, where the second toe opening 118 is larger than the first toe opening 116. In other words, the smaller circumference of the first toe opening 116 would serve to signal the location where the wearer 10 should insert her first hallux. Further, when worn as intended, the toe seam 124 of the open toe sock 100 will be primarily located on the lateral side half 140, as defined by the bisecting reference plane 122.

The toe seam 124, as shown, may extend from a first terminal end 142 on the top/dorsal portion 132 of the tubular body 128 to a second terminal end 144 on the bottom/plantar portion 134 of the tubular body 128. Further, in accordance with aspects herein, the bisecting reference plane 122 may extend through the first terminal end 142 as shown in FIG. 5A. And as shown in FIG. 5B, the bisecting reference plane 122 may further extend through the second terminal end 144 of the toe seam 124. In example aspects, the first terminal end 142 of the toe seam 124 may terminate at or near (e.g., within ±about 1 cm) the bisecting reference plane 122, and the second terminal end 144 of the toe seam 124 may terminate at or near (e.g., within about 1 cm) the bisecting reference plane 122. As used herein, the term "about" means within ±10% of a designated value. In example aspects, it is contemplated herein that FIGS. 5A and 5B represent the farthest medial position of the first terminal end 142 and the second terminal end 144 of the toe seam 124 to locate the toe seam 124 primarily on the lateral side half 140 of the open toe sock 100. It is contemplated, however, that the toe seam 124 may have the first terminal end 142 and the second terminal end 144 located differently from the locations illustrated in FIGS. 5A and 5B respectively. For example, the first terminal end 142 and the second terminal end 144 may be located anywhere between the farthest locations shown in FIG. 5A and FIG. 5B, respectively such that the first terminal end 142 and/or the second terminal end 144 are located lateral to the bisecting reference plane 122.

Figure 6A:
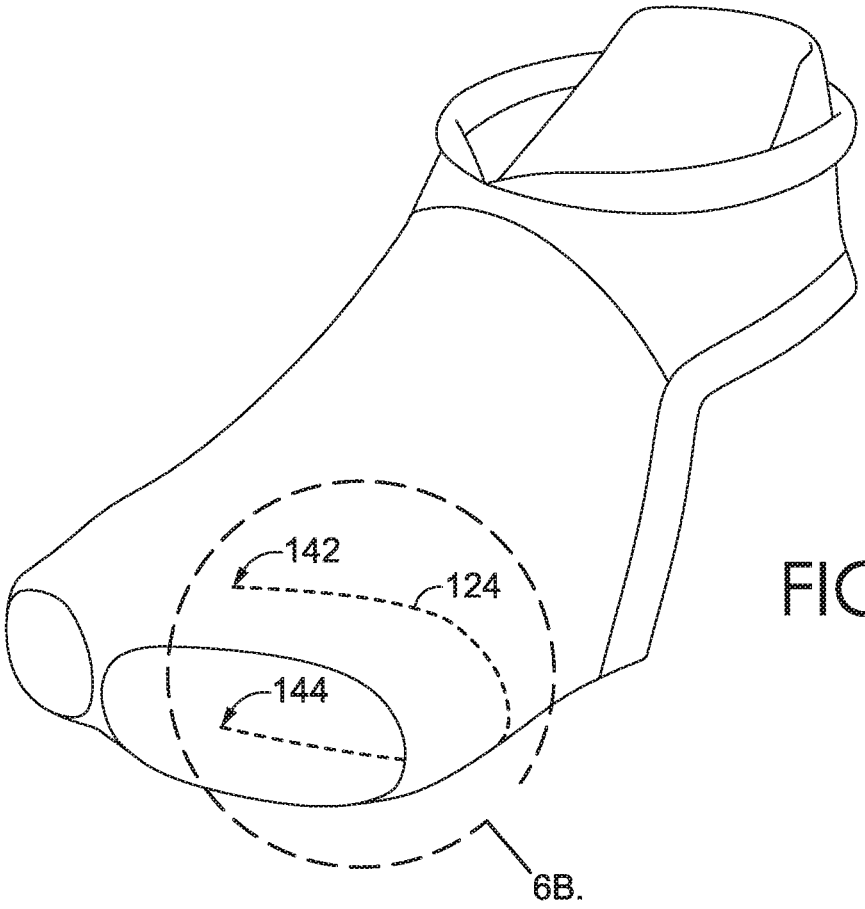
FIG. 6A illustrates the toe seam as it extends along the lateral side of the open toe sock, in accordance with aspects herein.
Figure 6B:
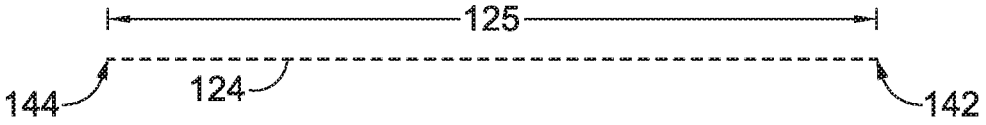
FIG. 6B illustrates a length of the toe seam extending between a first terminal end and a second terminal end of the toe seam, in accordance with aspects herein.

As discussed above, and as further shown in FIGS. 6A and 6B, the toe seam 124 comprises a toe-seam length 125 extending between the first terminal end 142 and the second terminal end 144. In some instances, the bisecting reference plane 122 (shown in FIGS. 5A-5B) may intersect or extend through the first terminal end 142, the second terminal end 144, or both the first terminal end 142 and the second terminal end 144. In a different aspect herein, more than 50% of the toe-seam length 125 may be located in the top/dorsal portion 132 of the lateral side half 140 (also known as the lateral dorsal portion), the bottom/plantar portion 134 of the lateral side half 140 (also known as the lateral plantar portion), or any combination thereof; more than 55% of the toe-seam length 125 may be located in the lateral dorsal portion, the lateral plantar portion, or any combination thereof; more than 60% of the toe-seam length 125 may be located in the lateral dorsal portion, the lateral plantar portion, or any combination thereof; more than 65% of the toe-seam length 125 may be located in lateral dorsal portion, the lateral plantar portion, or any combination thereof; more than 70% of the toe-seam length 125 may be located in the lateral dorsal portion, the lateral plantar portion, or any combination thereof; more than 75% of the toe-seam length 125 may be located in the lateral dorsal portion, the lateral plantar portion, or any combination thereof; more than 80% of the toe-seam length 125 may be located in the lateral dorsal portion, the lateral plantar portion, or any combination thereof; more than 85% of the toe-seam length 125 may be located in the lateral dorsal portion, the lateral plantar portion, or any combination thereof; more than 90% of the toe-seam length 125 may be located in the lateral dorsal portion, the lateral plantar portion, or any combination thereof; or 100% of the toe-seam length 125 may be located in the lateral dorsal portion, the lateral plantar portion, or any combination thereof.

Figure 7:
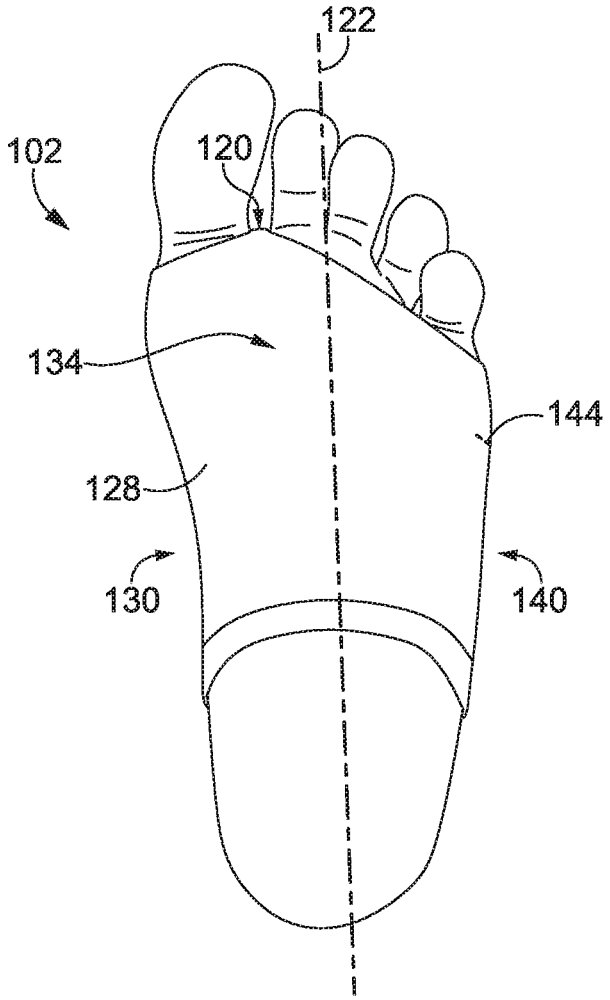
FIG. 7 illustrates a plantar view of an alternative open toe sock where the toe seam does not extend on to the plantar portion of the sock, in accordance with aspects herein.

In an alternative aspect and as shown in FIG. 7, the toe seam 124, may extend from the first terminal end 142 on the top/dorsal portion 132 of the tubular body 128 to a second terminal end 144 located generally, for example, at a lateral aspect of the tubular body 128 at a point where the top/dorsal portion 132 transitions to the bottom/plantar portion 134. In this aspect, the toe seam 124 does not extend fully on to the bottom/plantar portion 134 of the open toe sock 100.

Figure 9:
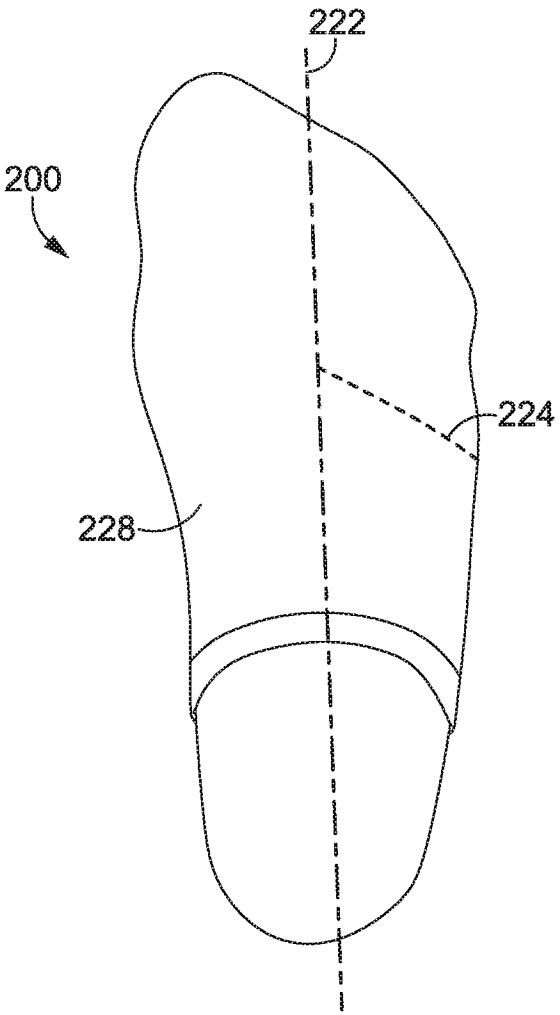
FIG. 9 illustrates a plantar view of the closed toe sock of FIG. 8, and shows a toe seam extending to a plantar portion of the closed toe sock, in accordance with aspects herein.
Figure 8:
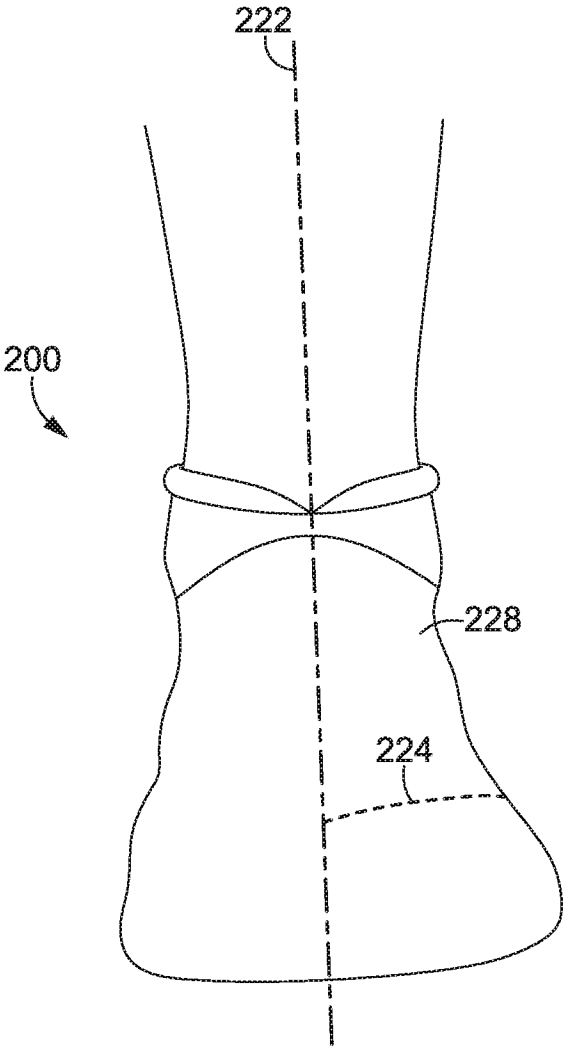
FIG. 8 illustrates a front view of a closed toe sock donned on a wearer's left foot, showing a bisecting reference plane that separates a medial side of the closed toe sock from a lateral side of the closed toe sock, in accordance with aspects herein.
Figure 11:
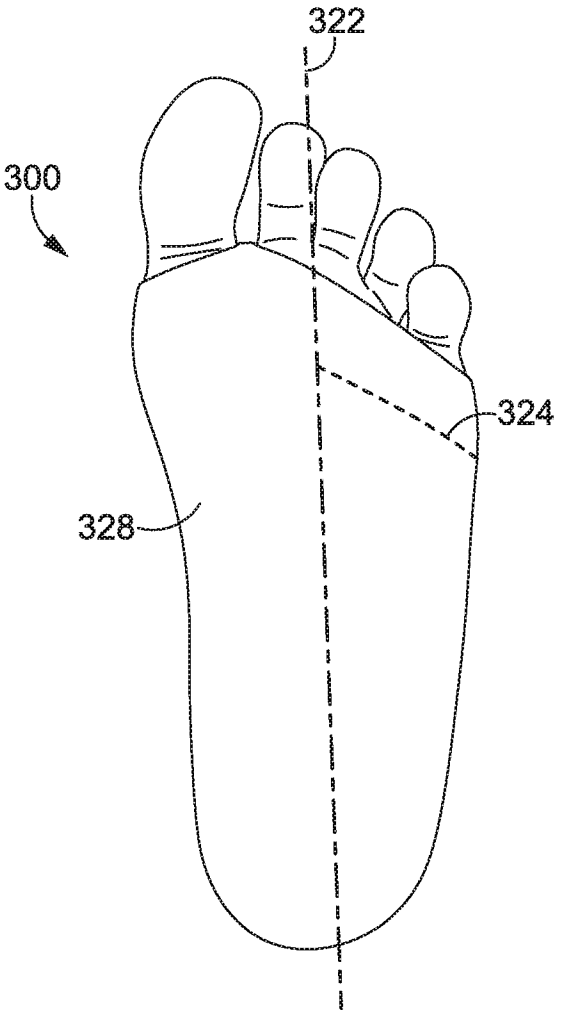
FIG. 11 illustrates a plantar view of the open toe sock of FIG. 10, and shows a toe seam extending to the plantar portion of the open toe sock, in accordance with aspects herein.
Figure 10:
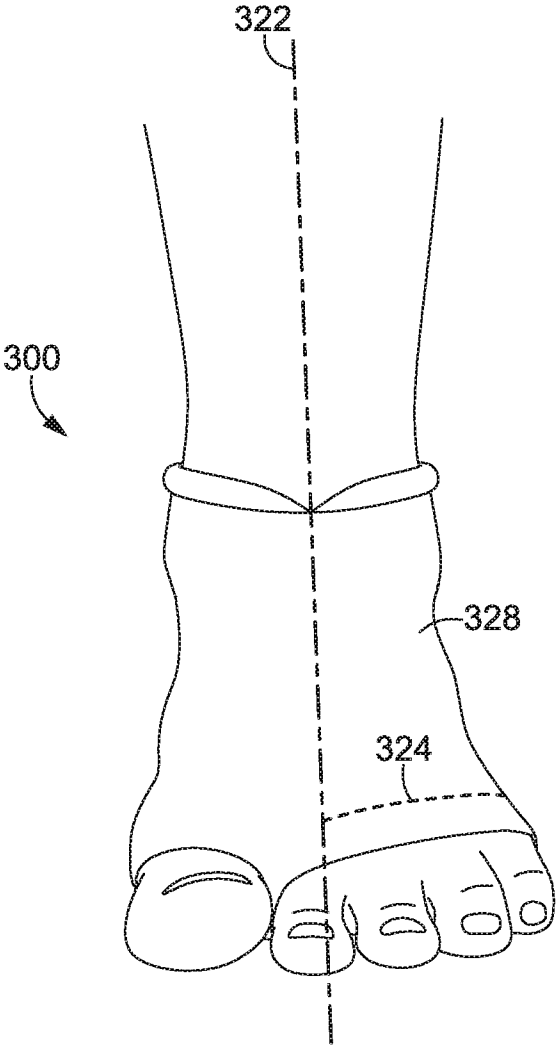
FIG. 10 illustrates a front view of an open toe sock donned on a wearer's left foot, showing a bisecting reference plane that separates a medial side of the open toe sock from a lateral side of the open toe sock, in accordance with aspects herein.
Figure 13:
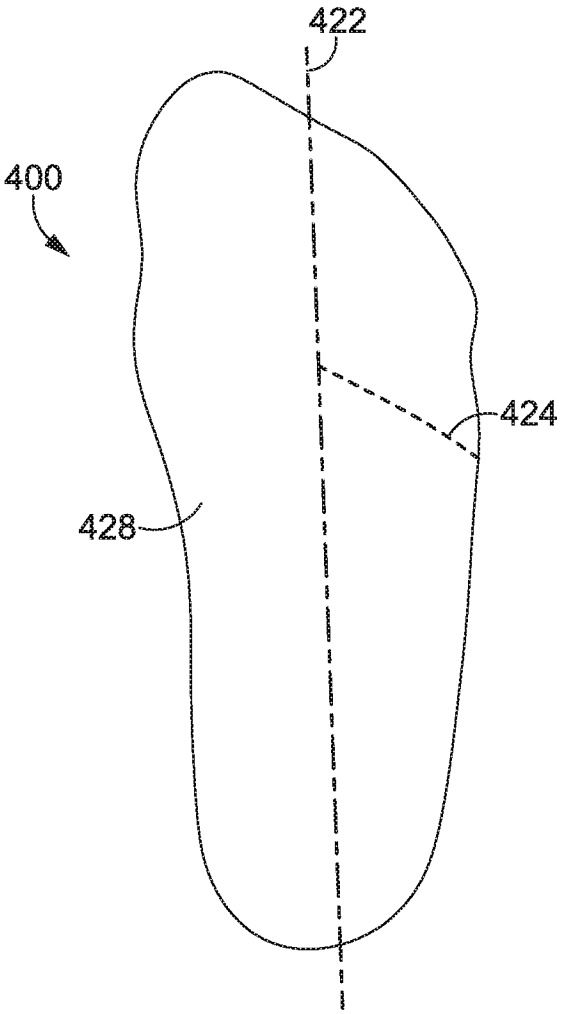
FIG. 13 illustrates a plantar view of the closed toe sock of FIG. 12, and shows a toe seam extending to the plantar portion of the closed toe sock, in accordance with aspects herein.
Figure 12:
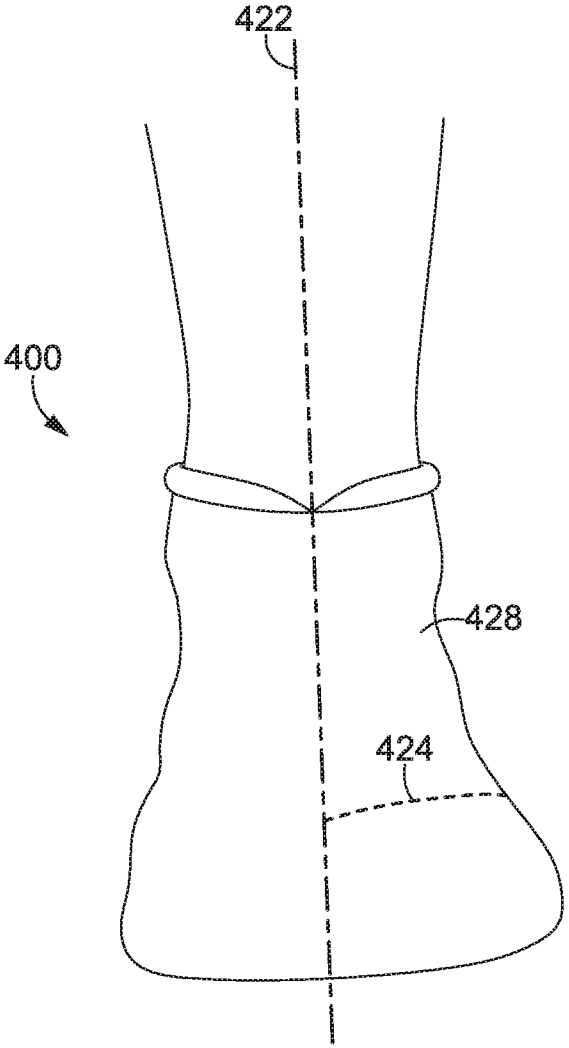
FIG. 12 illustrates a front view of a closed toe sock donned on a wearer's left foot, showing a bisecting reference plane that separates a medial side of the closed toe sock from a lateral side of the closed toe sock, in accordance with aspects herein.

Further, although the discussion above has focused on an open toe sock 100, it is contemplated that other types of socks such as a closed toe sock 200 shown in FIGS. 8 and 9 may comprise a toe seam 224 primarily located on the lateral side of a tubular body 228, as shown with respect to bisecting reference plane 222. As well, a closed heel sock 300 shown in FIGS. 10 and 11 may comprise a toe seam 324 primarily located on the lateral side of a tubular body 328, as shown with respect to bisecting reference plane 322. Further yet, a closed heel and closed toe sock 400 shown in FIGS. 12 and 13 may comprise a toe seam 424 primarily located on the lateral side of a tubular body 428, as shown with respect to bisecting reference plane 422.

Figure 14A:
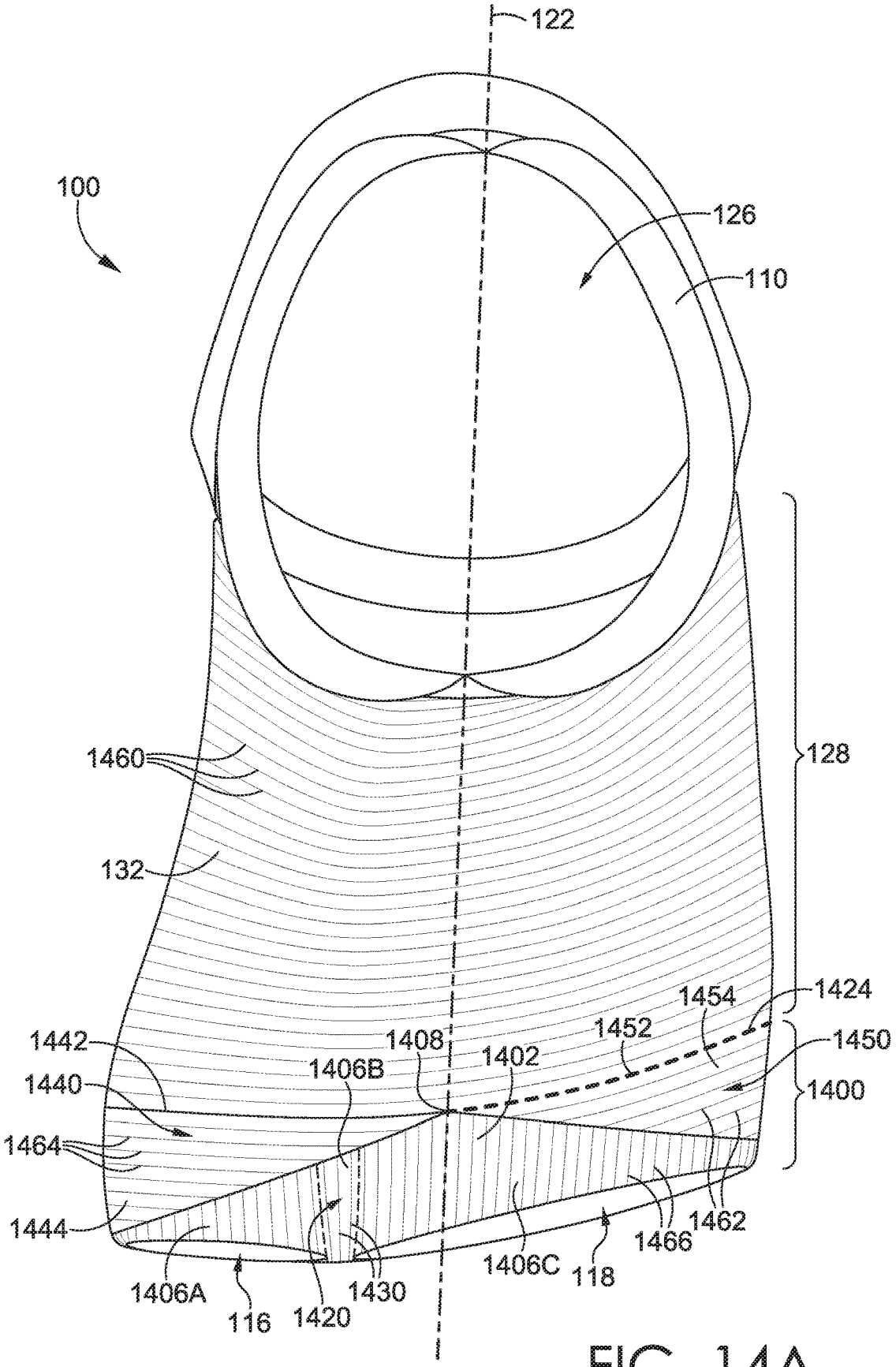
FIG. 14A illustrates a dorsal view of an open toe sock having a toe seam primarily located on a lateral side of the open toe sock, in accordance with aspects herein.
Figure 14B:
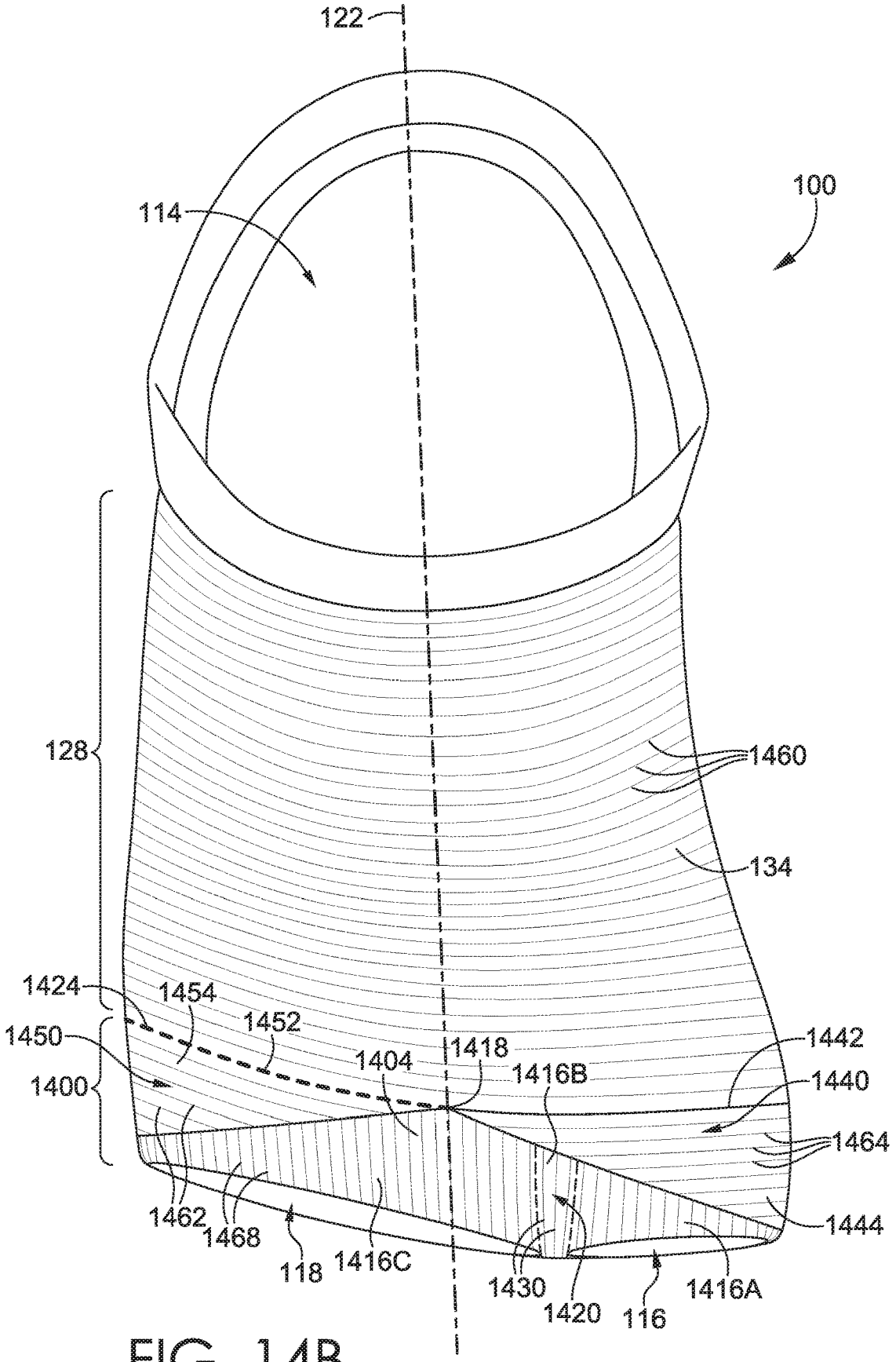
FIG. 14B illustrates a plantar view of the open toe sock of FIG. 14A, in accordance with aspects herein.

In aspects, the placement of the toe seam 124 may be achieved by reciprocally knitting a series of sections at the toe end of the open toe sock 100. The edge of the last knit section to be reciprocally knit may be seamed to the tubular body 128 to form the toe seam 124. FIGS. 14A and 14B illustrate the different reciprocally knit sections. FIG. 14A illustrates the top/dorsal portion 132 view of the open toe sock 100, and FIG. 14B illustrates the bottom/plantar portion 134 view of the open toe sock 100. With respect to FIG. 14A, the open toe sock 100 has a toe area 1400, which includes a dorsal segment 1402. The dorsal segment 1402 comprises a first dorsal triangular panel 1406A, a dorsal portion 1406B of a toe anchor segment 1420, and a second dorsal triangular panel 1406C. As shown in FIG. 14B, the toe area 1400 of the open toe sock 100 further comprises a plantar segment 1404. The plantar segment 1404 comprises a first plantar triangular panel 1416A, a plantar portion 1416B of the toe anchor segment 1420, and a second plantar triangular panel 1416C.

With continued reference to FIGS. 14A and 14B, the toe area 1400 of the open toe sock 100 further comprises a medial segment 1440 and a lateral segment 1450. The medial segment 1440 is formed from a medial triangular panel 1444 having a medial base 1442, where the medial base 1442 may extend from a point of intersection 1408 with the bisecting reference plane 122 on the top/dorsal portion 132 to a point of intersection 1418 with the bisecting reference plane 122 on the bottom/plantar portion 134. In a similar manner, the lateral segment 1450 is formed from a lateral triangular panel 1454 having a lateral base 1452, where the lateral base 1452 may extend from the point of intersection 1408 with the bisecting reference plane 122 on the top/dorsal portion 132 to the point of intersection 1418 with the bisecting reference plane 122 on the bottom/plantar portion 134. As will be further discussed, the lateral base 1452 may represent the edge of the last reciprocally knit section that is seamed to the tubular body 128 to form the toe seam 1424. It is contemplated herein that the medial segment 1440, at least a portion of the lateral segment 1450, the dorsal segment 1402, and the plantar segment 1404 are integrally knit with each other and with the tubular body 128.

In some aspects, the tubular body 128 of the open toe sock 100 may comprise circumferentially extending knit courses 1460. In some example aspects, knit courses 1462 that form the lateral segment 1450 and knit courses 1464 that form the medial segment 1440 of the toe area 1400 are in a generally parallel alignment with the knit courses 1460, but are reciprocally knit such that at least a portion of the knit courses 1462 that form the lateral segment 1450 and knit courses 1464 that form the medial segment 1440 of the toe area 1400, do not extend circumferentially around the open toe sock 100. In the same aspect, the dorsal segment 1402 of the toe area 1400 may comprise a plurality of reciprocally knit courses 1466 extending generally perpendicular to the circumferentially extending knit courses 1460. And in the same aspect, the plantar segment 1404 may comprise a plurality of reciprocally knit courses 1468 extending generally perpendicular to the plurality of circumferentially extending knit courses 1460. To describe this in a different way, the knit courses 1466 that form the dorsal segment 1402 and the knit courses 1468 that form the plantar segment 1404 of the toe area 1400 may be oriented to be generally perpendicular to the knit courses 1460 used to form the tubular body 128. This may be due to, for instance, how the open toe sock 100 is turned in the circular knit machine during the knitting of the reciprocally knit sections. In some aspects, toe anchor knit courses 1430 used to form the toe anchor 120 may also extend generally perpendicular to the plurality of circumferentially extending knit courses 1460, may extend generally perpendicular to the knit courses 1464 that form the medial segment 1440, and may extend generally perpendicular to the knit courses 1462 that form the lateral segment 1450. The toe anchor knit courses 1430 may extend generally parallel to the knit courses 1466 that form the dorsal segment 1402 and the knit courses 1468 that form the plantar segment 1404.

In some aspects of the open toe sock 100, the tubular body 128 and the plurality of toe anchor knit courses 1430 may comprise elastomeric yarns. Using elastomeric yarns may provide enhanced comfort to the wearer and allow the open toe sock 100 to be donned and doffed more easily. Alternatively or additionally, it is contemplated that the toe anchor knit courses 1430 of the toe anchor segment 1420 may have larger knitted loops than other courses in the open toe sock 100. This feature would further allow a greater degree of mechanical stretch compared to areas of the open toe sock 100 that are knit with smaller knitted loops.

Figure 15:
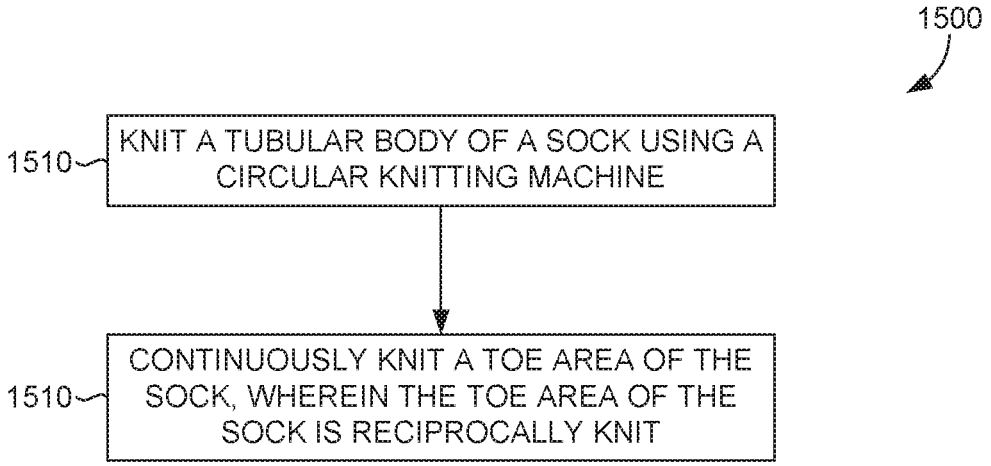
FIG. 15 illustrates a flow chart for a method of manufacturing a sock in accordance with aspects herein.

Moving on to FIG. 15, a flow chart of a method 1500 for manufacturing the open toe sock 100 in accordance with aspects herein, is shown. For example, as shown at step 1510, the method may include knitting a tubular body of a sock using a circular knitting machine using all the needles of the circular knitting machine, and as shown at step 1520, knitting continuously from the tubular body of the sock, a toe portion of the sock, wherein the toe portion of the sock is reciprocally knit in a number of different sections using a select number of needles of the circular knitting machine.

Figure 16:
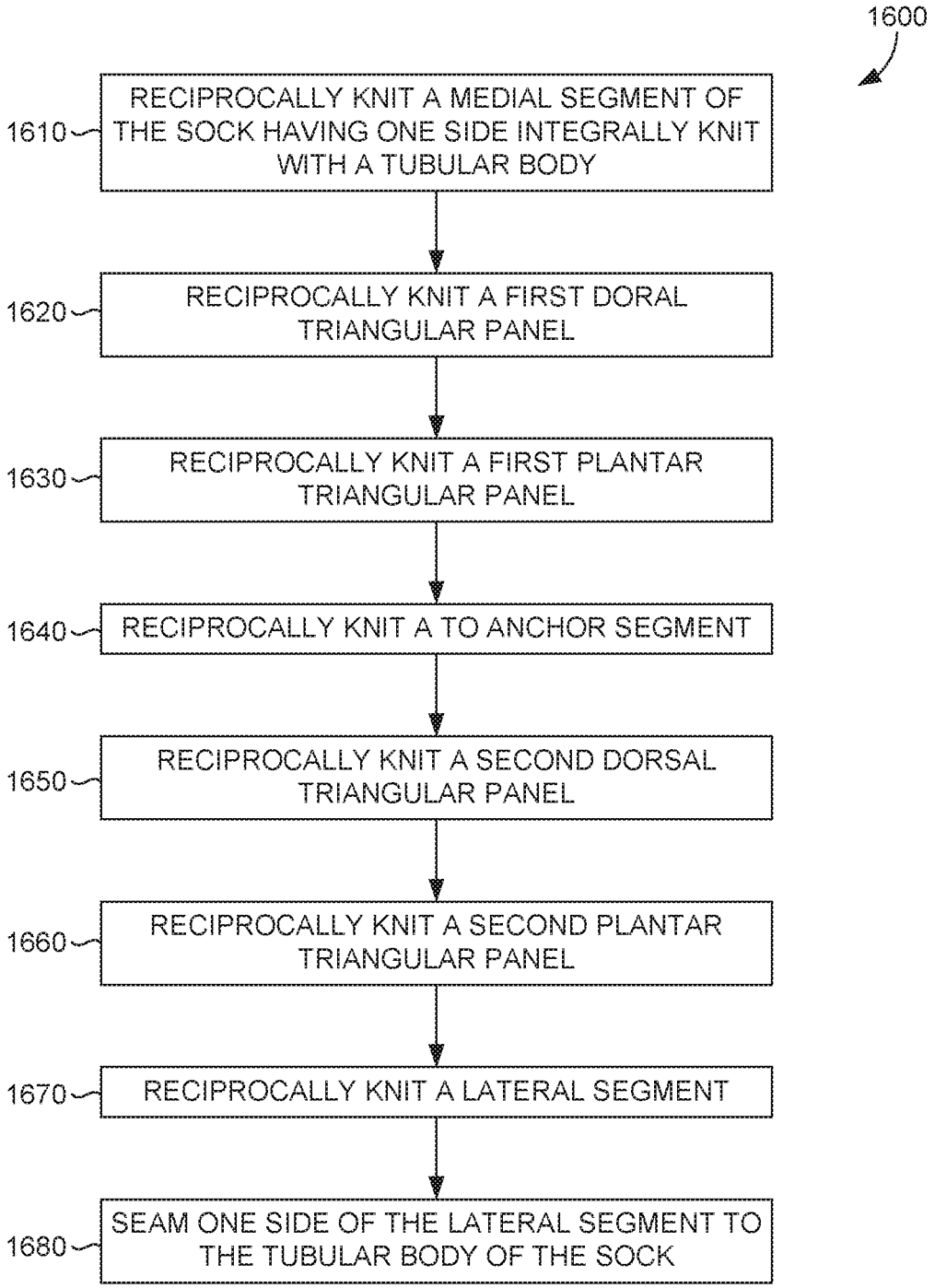
FIG. 16 illustrates a flow chart for an example method of manufacturing a toe portion of an open toe sock having a toe seam primarily located on a lateral side of the open toe sock, in accordance with aspects herein.

In accordance with aspects herein, the toe portion of the sock may be formed according to the method 1600 shown in FIG. 16. FIG. 16 describes a series of reciprocally knit sections, where the sections are knit in a certain order to produce the lateral toe seam described herein. Unless specified, the different reciprocally knit sections are integrally knit with each other. At step 1610, a medial segment, such as the medial segment 1440, is reciprocally knitted where a first side of the medial segment is integrally knit with the tubular body of the sock, as shown at step 1610. The knitting process may continue with reciprocally knitting a first dorsal triangular panel, such as the first dorsal triangular panel 1406A, having a first side integrally knit with a second side of the medial segment, as shown at step 1620, followed by reciprocally knitting a first plantar triangular panel, such as first plantar triangular panel 1416A, having a first side integrally knit with a third side of the medial segment, as shown at step 1630. The process may continue by reciprocally knitting a toe anchor segment, such as the dorsal portion 1406B of the toe anchor segment 1420 and the plantar portion 1416B of the toe anchor segment 1420, of the toe portion of the sock, as shown at step 1640, where a first side of the toe anchor segment is integrally knit with a second side of the first dorsal triangular panel and with a second side of the first plantar triangular panel. Then, the process may continue by reciprocally knitting a second dorsal triangular panel, such as the second dorsal triangular panel 1406C, having a first side integrally knit with a second side of the toe anchor segment, as shown at step 1650, followed by reciprocally knitting a second plantar triangular panel, such as the second plantar triangular panel 1416C, also having a first side integrally knit with the second side of the toe anchor segment, as shown at step 1660. Further, the process may continue by reciprocally knitting a lateral segment, such as the lateral segment 1450, of the toe portion of the sock, as shown at step 1670, where a first side of the lateral segment is integrally knit with a second side of the second dorsal triangular panel, and a second side of the lateral segment is integrally knit with a second side of the second plantar triangular panel. The lateral segment represents the final reciprocated section, and, as such, it comprises a free edge. Thus, step 1680 comprises seaming a third side (i.e., the free edge) of the lateral segment to the tubular body of the sock. The seaming may comprise a post-knitting step and include processes such as stitching, bonding, embroidering, and the like, that would be useful for providing a toe seam in the toe portion of the sock that is primarily located on a lateral side of the sock, in accordance with aspects herein.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A sock comprising:

a tubular body having a textile wall, wherein a bisecting reference plane bisects the tubular body into a medial side and a lateral side on opposing sides of the bisecting reference plane, wherein the medial side of the tubular body comprises a foot-locating feature, wherein the foot-locating feature is configured to engage an anatomical region of a medial portion of a foot of a wearer, when the sock is in an as-worn configuration; and wherein the lateral side of the tubular body comprises a toe seam having a first terminal end, a second terminal end, and a toe-seam length extending between the first terminal end and the second terminal end, and wherein the bisecting reference plane extends through at least the first terminal end of the toe seam.

Clause 2. The sock of clause 1, wherein the foot-locating feature is a toe anchor dividing a toe portion of the sock into a first toe opening and a second toe opening.

Clause 3. The sock of any of the preceding clauses further comprising, a heel opening configured to receive a heel portion of the wearer's foot when the sock is in the as-worn configuration.

Clause 4. The sock of any of clauses 2 and 3, wherein the first toe opening has a smaller diameter than the second toe opening.

Clause 5. The sock of any of clauses 2 through 4, wherein the first toe opening is configured to receive the wearer's hallux when the sock is in the as-worn configuration.

Clause 6. The sock of any of the preceding clauses, wherein the bisecting reference plane further extends through the second terminal end of the toe seam.

Clause 7. A sock comprising:

a tubular body having a medial dorsal portion, a medial plantar portion, a lateral dorsal portion, and a lateral plantar portion, wherein the tubular body is bisected by a bisecting reference plane, wherein the medial dorsal portion and the medial plantar portion are located on a first side of the bisecting reference plane and the lateral dorsal portion and the lateral plantar portion are located on a second side of the bisecting reference plane, wherein the first side is opposite the second side;

a foot-locating feature located in the medial dorsal portion, in the medial plantar portion, or any combination thereof, the foot-locating feature configured to engage an anatomical region of a medial portion of a foot of a wearer, when the sock is in an as-worn configuration; and a toe seam having a first terminal end, a second terminal end, and a toe-seam length extending between the first terminal end and the second terminal end, wherein the bisecting reference plane extends through at least the first terminal end of the toe seam, wherein more than 50% of the toe-seam length is located in the lateral dorsal portion, the lateral plantar portion, or any combination thereof.

Clause 8. The sock of clause 7, wherein more than 75% of the toe-seam length is located in the lateral dorsal portion, the lateral plantar portion, or any combination thereof.

Clause 9. The sock of any of the preceding clauses, wherein more than 90% of the toe-seam length is located in the lateral dorsal portion, the lateral plantar portion, or any combination thereof.

Clause 10. The sock of any of the preceding clauses, wherein an entirety of the toe-seam length is located on the lateral dorsal portion, the lateral plantar portion, or any combination thereof.

Clause 11. The sock of any of the preceding clauses, wherein the foot-locating feature is a toe anchor dividing a toe end of the tubular body into a first toe aperture and a second toe aperture.

Clause 12. The sock of clause 11, wherein the first toe aperture has a smaller diameter than the second toe aperture.

Clause 13. The sock of any of the preceding clauses further comprising, a heel end of the tubular body opposite the toe end, wherein the heel end comprises a heel aperture configured to receive a wearer's heel when the sock is in an as-worn configuration.

Clause 14. A pair of socks comprising:

a right-footed sock and a left-footed sock that are mirror images of one another;

the right-footed sock comprising:

a first tubular body having a first textile wall, wherein a first bisecting reference plane bisects the first tubular body into a first medial side and a first lateral side on opposing sides of the first bisecting reference plane, wherein the first medial side comprises a first foot-locating feature located on the first medial side of the first tubular body, and wherein the first foot-locating feature is configured to engage an anatomical region of a medial portion of a right foot of a wearer, when the right-footed sock is in an as-worn configuration; and wherein the first lateral side comprises a first toe seam having a first terminal end, a second terminal end, and a first toe-seam length extending between the first terminal end and the second terminal end, wherein the first bisecting reference plane extends through at least the first terminal end; and the left-footed sock comprising:

a second tubular body having a second textile wall, wherein a second bisecting reference plane bisects the second tubular body into a second medial side and a second lateral side on opposing sides of the second bisecting reference plane, wherein the second medial side comprises a second foot-locating feature located on the second medial side of the second tubular body, and wherein the second foot-locating feature is configured to engage the anatomical region of a medial portion of a left foot of a wearer, when the left-footed sock is in an as-worn configuration; and wherein the second lateral side comprises a second toe seam having a third terminal end, a fourth terminal end, and second toe-seam length extending between the third terminal end and the fourth terminal end, wherein the second bisecting reference plane extends through at least the third terminal end.

Clause 15. The pair of socks of clause 14, wherein the first tubular body comprises a first heel portion having a first opening configured to receive a heel portion of the wearer's right foot when the right-footed sock is in the as-worn configuration; and wherein the second tubular body comprises a second heel portion having a second opening configured to receive a heel portion of the wearer's left foot when the left-footed sock is in the as-worn configuration.

Clause 16. The pair of socks of any of the preceding clauses, wherein the first foot-locating feature is comprised of a first toe anchor and the second foot-locating feature is comprised of a second toe anchor, and wherein each of the first toe anchor and the second toe-anchor divides a toe portion of each of the respective first tubular body and the second tubular body into a first toe opening and a second toe opening.

Clause 17. The pair of socks of clause 16, wherein the first toe opening has a smaller diameter than the second toe opening.

Clause 18. The pair of socks of any of clauses 16-17, wherein the first toe opening of each of the right-footed sock and the left-footed sock is configured to receive the wearer's respective hallux when each of the right-footed sock and the left-footed sock are in the as-worn configuration.

Clause 19. A method for forming a toe portion of a sock, the method comprising:

reciprocally knitting a medial segment of the sock, the medial segment having a first side integrally knit with a tubular knit body of the sock;

reciprocally knitting a first dorsal triangular panel of the toe portion;

reciprocally knitting a first plantar triangular panel of the toe portion;

reciprocally knitting a toe anchor segment of the toe portion;

reciprocally knitting a second dorsal triangular panel of the toe portion;

reciprocally knitting a second plantar triangular panel of the toe portion;

reciprocally knitting a lateral segment of the toe portion; and seaming one side of the lateral segment of the toe portion to the tubular knit body of the sock.

Clause 20. The method of clause 19, wherein the seaming comprises one of stitching, bonding, or embroidering the one side of the lateral segment of the toe portion to the tubular knit body of the sock.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations and are contemplated within the scope of the claims. Not all steps listed in the various figures need be carried out in the specific order described.

Having thus described the invention, what is claimed is:

1. A knit sock comprising:

a seamless knit tubular body having a textile wall;

a toe portion including a reciprocally knit segment comprising a free edge, wherein a bisecting reference plane bisects the toe portion into a medial side and a lateral side on opposing sides of the bisecting reference plane, the medial side of the toe portion comprising an integrally knit toe anchor, wherein the integrally knit toe anchor is configured to engage an anatomical region of a medial portion of a foot of a wearer when the knit sock is in an as-worn configuration, and wherein the medial side of the toe portion is free of seams; and a toe seam located on the lateral side of the toe portion, the toe seam joining the free edge of the reciprocally knit segment to the seamless knit tubular body, the toe seam having a first terminal end, a second terminal end, and a toe-seam length extending between the first terminal end and the second terminal end, wherein the bisecting reference plane extends through at least the first terminal end of the toe seam.

2. The knit sock of claim 1, wherein the integrally knit toe anchor divides the toe portion of the knit sock into a first toe aperture and a second toe aperture.

3. The knit sock of claim 2 further comprising, a heel opening configured to receive a heel portion of the foot of the wearer when the knit sock is in the as-worn configuration.

4. The knit sock of claim 2, wherein the first toe aperture has a smaller diameter than the second toe aperture.

5. The knit sock of claim 2, wherein the first toe aperture is configured to receive a hallux of the wearer when the knit sock is in the as-worn configuration.

6. The knit sock of claim 1, wherein the bisecting reference plane further extends through the second terminal end of the toe seam.

7. The knit sock of claim 1 wherein more than 50% of the toe-seam length is located in a lateral dorsal portion, a lateral plantar portion, or any combination thereof of the lateral side of the seamlessly knit tubular body.

8. The knit sock of claim 1, wherein more than 75% of the toe-seam length is located in a lateral dorsal portion, a lateral plantar portion, or any combination thereof of the lateral side of the seamlessly knit tubular body.

9. The knit sock of claim 1, wherein more than 90% of the toe-seam length is located in a lateral dorsal portion, a lateral plantar portion, or any combination thereof of the lateral side of the seamlessly knit tubular body.

10. A knit sock comprising:

a seamlessly knit tubular body having a medial dorsal portion, a medial plantar portion, a lateral dorsal portion, and a lateral plantar portion, wherein the knit sock is bisected by a bisecting reference plane into a medial side and a lateral side, wherein the medial dorsal portion and the medial plantar portion are located on the medial side of the bisecting reference plane, and the lateral dorsal portion and the lateral plantar portion are located on the lateral side of the bisecting reference plane, wherein the medial side is opposite the lateral side;

a toe portion including a reciprocally knit segment comprising a free edge, where in the bisecting reference plane further bisects the toe portion into a me dial toe portion and a lateral toe portion, and wherein the medial toe portion is free of seams;

an integrally knit toe anchor located in the medial dorsal portion, in the medial plantar portion, or any combination thereof, the integrally knit toe anchor configured to engage an anatomical region of a medial portion of a foot of a wearer, when the knit sock is in an as-worn configuration; and a toe seam located at the lateral toe portion and joining the free edge of the reciprocally knit segment of the knit sock to the lateral dorsal portion and the lateral plantar portion of the seamlessly knit tubular body, the toe seam having a first terminal end, a second terminal end, and a toe-seam length extending between the first terminal end and the second terminal end, wherein the bisecting reference plane extends through at least the first terminal end of the toe seam, wherein more than 50% of the toe-seam length is located in the lateral dorsal portion, the lateral plantar portion, or any combination thereof.

11. The knit sock of claim 10, wherein more than 75% of the toe-seam length is located in the lateral dorsal portion, the lateral plantar portion, or any combination thereof.

12. The knit sock of claim 11, wherein more than 90% of the toe-seam length is located in the lateral dorsal portion, the lateral plantar portion, or any combination thereof.

13. The knit sock of claim 12, wherein an entirety of the toe-seam length is located on the lateral dorsal portion, the lateral plantar portion, or any combination thereof.

14. The knit sock of claim 10, wherein the integrally knit toe anchor divides the toe portion of the knit sock into a first toe aperture and a second toe aperture.

15. The knit sock of claim 14, wherein the first toe aperture has a smaller diameter than the second toe aperture.

16. The knit sock of claim 15 further comprising, a heel end of the seamlessly knit tubular body opposite the toe portion, wherein the heel end comprises a heel aperture configured to receive a wearer's heel when the knit sock is in the as-worn configuration.

17. A method for forming a knit sock, the method comprising:

knitting a seamless tubular knit body of the knit sock;

continuously knitting a toe portion of the knit sock, wherein the knitting the toe portion comprises:

reciprocally knitting a medial segment of the knit sock, the medial segment having a first side integrally knit with the seamless tubular knit body of the knit sock;

reciprocally knitting a first dorsal triangular panel of the toe portion;

reciprocally knitting a first plantar triangular panel of the toe portion;

reciprocally knitting a toe anchor segment of the toe portion;

reciprocally knitting a second dorsal triangular panel of the toe portion;

reciprocally knitting a second plantar triangular panel of the toe portion;

reciprocally knitting a lateral segment of the toe portion; and seaming a free edge of one side of the lateral segment of the toe portion to the seamless tubular knit body of the knit sock by forming a toe seam, wherein the toe seam extends between a first terminal end and a second terminal end, wherein the toe portion is bisected into a medial side and a lateral side on opposing sides by a bisecting reference plane, wherein the bisecting reference plane extends through at least the first terminal end of the toe seam, and wherein the medial side of the toe portion is free of seams.

18. The method of claim 17, wherein the seaming comprises one of stitching, bonding, or embroidering the one side of the lateral segment of the toe portion to the seamless tubular knit body of the knit sock.

19. The method of claim 17, wherein the toe anchor segment divides the toe portion of the knit sock into a first toe aperture and a second toe aperture.

20. The method of claim 19, wherein the first toe aperture has a smaller diameter than the second toe aperture.

* * * * *